US009820553B2

(12) United States Patent
Shimley et al.

(10) Patent No.: US 9,820,553 B2
(45) Date of Patent: Nov. 21, 2017

(54) APPARATUS AND METHOD FOR APPLYING COSMETIC EYEBROWS

(71) Applicants: Patsy A. Shimley, Lawrenceville, GA (US); Dale C. Beal, Jr., Augusta, GA (US)

(72) Inventors: Patsy A. Shimley, Lawrenceville, GA (US); Dale C. Beal, Jr., Augusta, GA (US)

( * ) Notice: Subject to any disclaimer, the term of this patent is extended or adjusted under 35 U.S.C. 154(b) by 170 days.

(21) Appl. No.: 14/988,795

(22) Filed: Jan. 6, 2016

(65) Prior Publication Data

US 2016/0360861 A1 Dec. 15, 2016

Related U.S. Application Data

(60) Provisional application No. 62/175,012, filed on Jun. 12, 2015.

(51) Int. Cl.
*A45D 40/30* (2006.01)
*A45D 40/26* (2006.01)

(52) U.S. Cl.
CPC ..... *A45D 40/30* (2013.01); *A45D 40/26* (2013.01); *A45D 2200/1027* (2013.01); *A45D 2200/1036* (2013.01)

(58) Field of Classification Search
CPC ..... A45D 40/26; A45D 40/30; A45D 2200/1027; A45D 2200/1036; A41G 5/02; B44D 2/007
See application file for complete search history.

(56) References Cited

U.S. PATENT DOCUMENTS 2,998,821 A * 9/1961 Hurdel ..... A45D 40/30 132/218
3,485,251 A * 12/1969 Brunet ..... A45D 40/30 132/216
2013/0337225 A1 12/2013 Beal et al.

* cited by examiner

*Primary Examiner* — Rachel Steitz
(74) *Attorney, Agent, or Firm* — Asgaard Patent Services, LLC; F. Wayne Thompson, Jr.

(57) ABSTRACT

Implementations of an apparatus and method for applying cosmetic eyebrows are provided. In some implementations, the eyebrow applicator may be used to apply a cosmetic eyebrow on each brow ridge of a user. In some implementations, the eyebrow applicator may comprise a left brow applicator and a right brow applicator separated by a core ply having a window therethrough. In some implementations, a cosmetic formula in the shape of an eyebrow may be deposited on each of the brow applicators. In some implementations, the right brow and the left brow applicators may be positioned on the assembled eyebrow applicator so that the side of each brow applicator having the cosmetic formula thereon is secured to the core ply and the cosmetic formula is thereby positioned within the window. In this way, the brow applicators are kept separated thereby preventing smudging and/or smearing of the cosmetic formula thereon.

17 Claims, 3 Drawing Sheets

APPARATUS AND METHOD FOR APPLYING COSMETIC EYEBROWS

CROSS REFERENCE TO RELATED APPLICATION

This application claims the benefit of U.S. Patent Application Ser. No. 62/175,012, which was filed on Jun. 12, 2015, and is incorporated herein by reference in its entirety.

TECHNICAL FIELD

This disclosure relates to implementations of an apparatus and method for applying cosmetic compositions to the body. More specifically, the present invention relates to an apparatus and method for applying cosmetic eyebrows to the face of a user, specifically, the supraorbital ridges of the user.

BACKGROUND

In many ways, the overall appearance of an eyebrow is affected by its arch, length, and thickness. Hair loss or sparse hair on the eyebrow may occur for many reasons (e.g., chemotherapy) and thereby leave a person with unaesthetic eyebrows. Methods of creating an aesthetically pleasing eyebrow having generally included the removal of unwanted hair or the filling in of a sparse and/or lightly colored eyebrow.

Various products have been designed to fill-in or recreate an eyebrow. Example products include brown powder, eyebrow pencils, and eyebrow gels. The goal of these products is not only to fill-in an eyebrow, or the complete recreation of an eyebrow when needed, but also to create a bilateral symmetry between a user's eyebrows such that the eyebrows have the same visual characteristics (e.g., shape, thickness, size, and/or relative position on the supraorbital ridge). However, the previously mentioned products have several drawbacks. First, the ability to create two eyebrows having the same visual characteristics is limited by the user's manual dexterity and artistic abilities. Second, proper positioning of an eyebrow on the supraorbital ridge requires trial and error since no method of ascertaining a suitable location prior to application is provided for. Third, the desirability of a particular color or shape of an eyebrow cannot be determined until the cosmetic eyebrow is applied to the user's brow ridge.

Thus, there is a need for an apparatus and method for applying cosmetic eyebrows that enables for the selection of a desired shape, color, and size prior to application. Further, there is a need for an apparatus and method for applying cosmetic eyebrows that allows for the proper positioning of the cosmetic eyebrow prior to application on the brow ridge of a user.

SUMMARY OF THE INVENTION

In one implementation of the invention, an eyebrow applicator is provided. The eyebrow applicator may comprise a laminate structure having a left brow applicator, a right brow applicator, and a core ply positioned therebetween. The core ply is used to separate and thereby prevent contact between the left and right brow applicators. In some implementations, the core ply comprises a first side, a second side, and a centrally located window. In some implementations, the left and right brow applicators may each comprise a clear polymer film having a cosmetic formula deposited on an interiorly-facing surface thereof.

The cosmetic formula is positioned on each brow applicator so that when the brow applicators are secured to the core ply the cosmetic formula is located within the window of the core ply. In this way, the cosmetic formula is protected from inadvertent contact and smudging. In some implementations, the core ply may include an adhesive on the first side and the second side used to removably secure the left and right brow applicators thereto.

A method of applying cosmetic eyebrows using the eyebrow applicator described herein is provided. Initially, after selecting a desired cosmetic eyebrow, a user applies the cosmetic eyebrow by peeling off a left or right brow applicator from the core ply of the eyebrow applicator. Then, the user positions the cosmetic eyebrow over a desired placement site on their brow ridge by virtue of the clear polymer film. The clear polymer film allows the user to ascertain a desired placement location for the cosmetic eyebrow prior to its application on the brow ridge. Next, the user presses the selected eyebrow applicator to their brow ridge. In this way, a portion of the cosmetic formula deposited on the brow applicator may be deposited at the desired placement location on the user's skin. Then, the user may blot the cosmetic formula deposited on their skin with absorbent material, such as a tissue or other absorbent material.

In some implementations, the method of applying cosmetic eyebrows may further comprise, selecting a desired cosmetic eyebrow from a selection of cosmetic eyebrows of varying size, shape, and/or color. The selection of a cosmetic eyebrow may be made in context of a user's brow ridge by using the window of the eyebrow applicator, or the look and appeal of the eyebrow, to make an initial selection. By using the window of the applicator, the user may ascertain if the selected cosmetic eyebrow would be aesthetically pleasing if applied. Then, if the selected cosmetic eyebrow is undesirable to the user, another size, shape, and/or color of cosmetic eyebrow may be examined and selected for use.

The present invention provides for the convenient, easy, and direct application of cosmetics, such as a cosmetic eyebrow, to a brow ridge of a user. The eyebrow applicator is compact and configured to substantially minimize the possibility of smudging the cosmetic formula deposited on the brow applicators. Smudging of the cosmetic formula is minimized due to the construction of the eyebrow applicator. Further, the present invention, through the use of clear brow applicators, allows a user to select a location to place each cosmetic eyebrow before applying the cosmetic formula to their brow ridge. In some implementations, the eyebrow applicator includes a reusable adhesive on the first and/or second sides of the core ply so that the brow applicators may be removably secured thereto. In some implementations, each brow applicator includes sufficient cosmetic formula thereon to enable multiple applications thereof.

DETAILED DESCRIPTION

Figure 1:
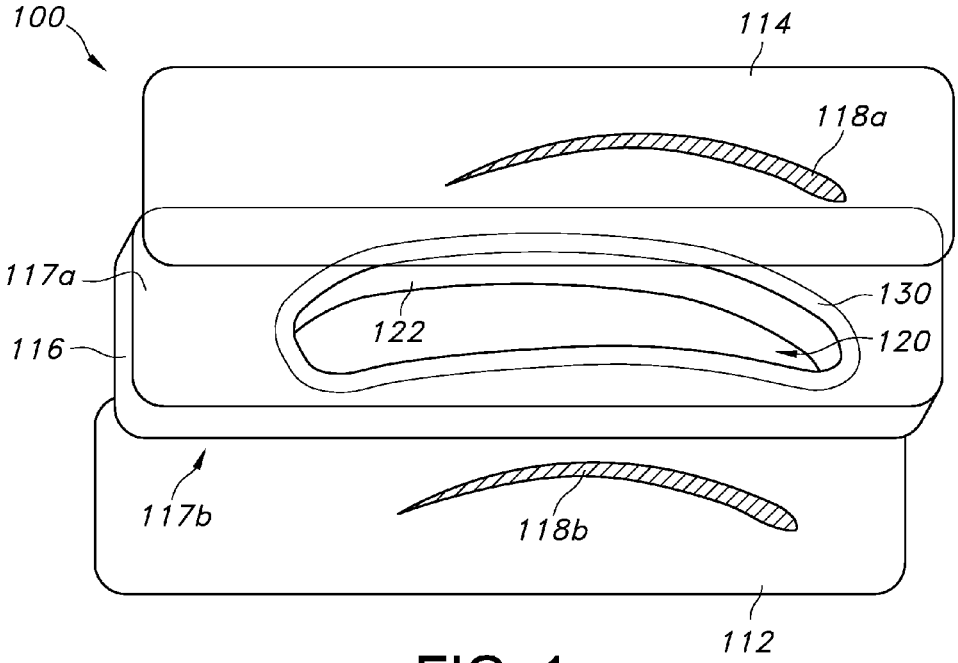
FIG. 1 illustrates an exploded view of an example eyebrow applicator according to the principles of the present disclosure.
Figure 2:
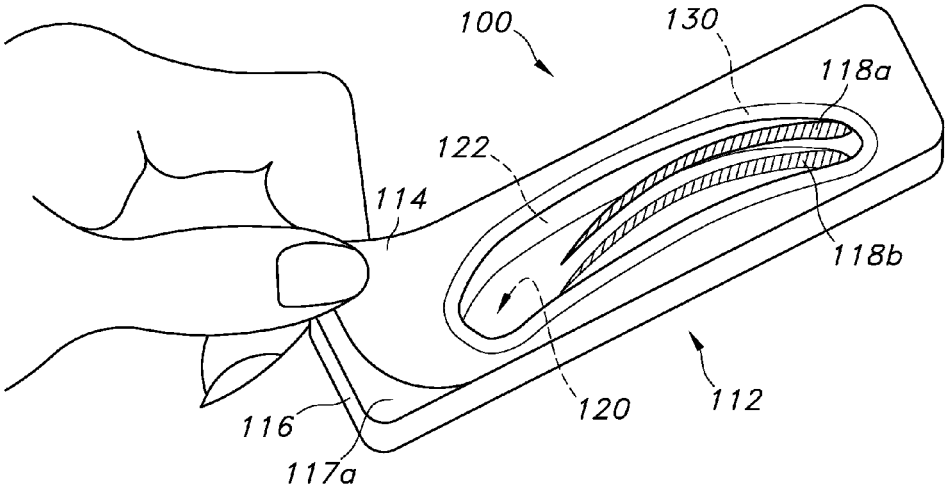
FIG. 2 illustrates an example implementation of the eyebrow applicator shown in FIG. 1.

FIGS. 1 and 2 illustrate an example implementation of an eyebrow applicator 100 according to the principles of the present disclosure. In some implementations, the eyebrow applicator 100 may be used to apply a cosmetic eyebrow on each brow ridge of a user. In some implementations, the eyebrow applicator 100 is compact and may provide thereon cosmetic eyebrows of varying shape, color, and/or size. In some implementations, the eyebrow applicator 100 provides for the convenient, easy, and/or direct application of cosmetic eyebrows to a user's face.

In some implementations, as shown in FIG. 1, the eyebrow applicator may comprise a left brow applicator 112 and a right brow applicator 114 separated by a core ply 116. In some implementations, the right brow applicator 114 and the left brow applicator 112 may be removably secured to the first side 117*a* and the second side 117*b*, respectively, of the core ply 116 (see, e.g., FIGS. 1 and 2). In this way, the eyebrow applicator 100 has a laminate structure. In some implementations, a cosmetic formula 118*a* and 118*b* shaped like an eyebrow may be deposited on the right brow applicator 114 and the left brow applicator 112, respectively (see, e.g., FIG. 1).

As shown in FIG. 2, in some implementations, the shape of the left brow applicator 112 and right brow applicator 114 may generally correspond to the shape of the core ply 116. In some implementations, the left brow applicator 112 and right brow applicator 114 may have a generally rectangular shape (see, e.g., FIG. 1). In some implementations, the left brow applicator 112 and right brow applicator 114 may have the general shape of an oval, circle, square, and/or other irregular shape. In some implementations, the left brow applicator 112 and right brow applicator 114 may be shaped differently than the core ply 116.

In some implementations, both the left brow applicator 112 and right brow applicator 114 are made of a clear polymer film. In some implementations, the clear polymer film may have a thickness ranging between 0.001 inch to 0.02 inch, inclusive of 0.001" (inch) and 0.002" (inch). In some implementations, the thickness of the clear polymer film may be up to 0.003" (inch) thick. In some implementations, the left brow applicator 112 and right brow applicator 114 may be made of a polyester film, for example, polyethylene terephthalate (PET). In some implementations, the left brow applicator 112 and right brow applicator 114 may be made of any suitable clear polymer film (e.g., polyesters, polypropylenes, polyethylenes).

As shown in FIGS. 1 and 2, in some implementations, the cosmetic formula 118*a*, 118*b* may be deposited on or near the longitudinal axis of the right brow applicator 114 and left brow applicator 112, respectively. In some implementations, a surface of each brow applicator 112, 114 may be pretreated and/or coated to facilitate the placement of the cosmetic formula 118*a*, 118*b* thereon.

In some implementations, the cosmetic formula 118*a*, 118*b* may be deposited on the right brow application 114 and the left brow applicator 112, respectively, by any printing method known to one of ordinary skill in the art. Example printing methods include, but are not limited to, screen printing, pad printing, flexographic, letter press, and/or ink jet printing.

In some implementations, a chemical pretreatment (e.g., acrylic co-polyester, urethane, and/or microcrystalline wax) may be used on the surface of the clear polymer film of the brow applicators 114, 112 to facilitate printing (or adhering) the cosmetic formula 118*a*, 118*b* thereon. In some implementations, the thickness of the acrylic co-polyester and/or urethane coating may be up to 4 microns thick. In implementations where microcrystalline wax is used, the microcrystalline wax used possesses absorbent properties. In some implementations, the use of the chemical pretreatment may be limited to the area of the clear polymer film of each brow applicator 114, 112 where the cosmetic formula 118*a*, 118*b* is deposited.

In some implementations, a release agent (or de-moulding agent) (e.g., silicone) may be applied to the brow applicators 114, 112 to thereby control and/or facilitate their removal from the core ply 116. In some implementations, the release agent may be used to minimize or prevent the appearance of an adhesive on the brow applicators 114, 112 after their separation from the core ply 116. In some implementations, the release agent may be used to prevent the brow applicators 114, 112 from bonding to the core ply 116. The release agent may be pattern printed onto the brow applicators 114, 112 by methods known to one of ordinary skill in the art. In some implementations, a release agent may not be applied to the brow applicators 114, 112.

In some implementations, the brow applicators 114, 112 may include various indicia thereon (e.g., company name(s), logos, etc . . . ).

As shown in FIG. 1, in some implementations, the cosmetic formula 118*a*, 118*b* may be deposited on each brow applicator 114, 112 in the shape of an eyebrow. In this way, a cosmetic eyebrow is formed on each brow applicator 114, 112. In some implementations, the cosmetic formula 118*a*, 118*b* may be deposited on each brow applicator 114, 112 in any number of patterns and/or shapes that may resemble an eyebrow. In some implementations, the cosmetic formula 118*a*, 118*b* may be deposited onto each brow applicator 114, 112 in an amorphous state. In some implementations, the cosmetic formula 118*a*, 118*b* may be deposited on the brow applicators 114, 112 in any number of patterns or shapes.

In some implementations, the cosmetic formula 118*a*, 118*b* may comprise a uniform mixture of cosmetic waxes, oils, pigments, and/or emollients. In some implementations, the cosmetic formula 118*a*, 118*b* is a mixture of wax (e.g., microcrystalline wax) and oils used to initially create a soft amorphous composition. The wax is used to provide structure to the composition. In some implementations, pigments and/or dyes may be used to color the composition. In some implementations, the composition used to create the cosmetic formula 118*a*, 118*b* is not subjected to heat during preparation. In this way, the composition may be prevented from hardening. In some implementations, the composition used to create the cosmetic formula 118*a*, 118*b* may be similar (e.g., include similar percentages of waxes and/or oils) to a composition formulation used to make lipstick.

As shown in FIGS. 1 and 2, in some implementations, the core ply 116 may have a generally rectangular shape. In some implementations, the shape of the core ply 116 may correspond to the shape of the left and right brow applicators 112, 114 (see, e.g., FIG. 2). In some implementations, the first side 117*a* and the second side 117*b* of the core ply 116 are parallel or substantially parallel to each other (see, e.g., FIG. 1). In some implementations, the core ply 116 may have the general shape of an oval, circle, square, and/or other irregular shape. In some implementations, the shape of the core ply 116 may not correspond to the shape of the left and right brow applicators 112, 114.

In some implementations, the core ply 116 may have a thickness ranging from 0.05" inch to 0.25" inch, inclusive of 0.05" (inch) to 0.25" (inch). In some implementations, the core ply 116 may be made of paperboard, rigid and/or flexible polymer foams (e.g., polyvinyl chloride (PVC), ethyl vinyl acetate (EVA)), injection molded and/or thermoformed plastics, corrugated paper board, and/or plastic, or a combination thereof. In one implementation, the core ply 116 is rigid polystyrene foam that is approximately 0.15" (inch) thick. In some implementations, the core ply 116 is made from foam and the first side 117*a* and the second side 117*b* thereof may be laminated with a foil-coated paper. Such lamination may be utilized for decorative effect, to add rigidity to the core ply 116, and/or to increase the overall thickness of the core ply 116. Increasing the rigidity of the core ply 116 is especially important if the core ply 116 is made of a softer foam.

As shown in FIG. 1, in some implementations, the first side 117*a* and the second side 117*b* of the core ply 117 may have an adhesive 130 thereon. The adhesive 130 on the core ply allows for the attachment and removal of the right brow 114 and left brow 112 applicators. In some implementations, the adhesive 130 may only be deposited on the portion of the first side 117*a* and the second side 117*b* of the core ply 116 adjacent the interior edge 122 of the window 120 (see, e.g., FIG. 2). In this way, at least a portion of the core ply 116 in contact with each brow applicator 114, 112 is devoid of adhesive 130 thereby allowing for the easy removal of each brow applicator 114, 112 (see, e.g., FIG. 2).

As shown in FIG. 2, in some implementations, the adhesive 130 used on the first side 117*a* and second side 117*b* of the core ply 116 may be a pressure sensitive adhesive. In this way, the right brow 114 and the left brow 112 applicators may be removably secured to the core ply 116 multiple times. One of ordinary skill in the art having the benefit of the present disclosure would know how to select an appropriate adhesive 130 to use with the eyebrow applicator 100.

In some implementations, the adhesive 130 may be printed on the core ply 116 using any printing method known to one of ordinary skill in the art. Example printing methods include, but are not limited to, screen printing, pad printing, flexographic, letter press, and/or ink jet printing. In some implementations, the adhesive 130 may be pattern printed onto the core ply 116 (see, e.g., FIG. 2). In some implementations, a release agent negates the adhesive properties of the adhesive 130 on the area outside of the pattern printed area of the core ply 116. In this way, the appearance of the adhesive 130 on the brow applicators 114, 112 after removal from the core ply 116 may be minimized or prevented.

As shown in FIG. 1, in some implementations, the core ply 116 may further comprise a die-cut aperture forming a window 120 therethrough. In some implementations, the window 120 may be positioned in the central region of the core ply 116 (see, e.g., FIG. 2). In some implementations, the window 120 may not be positioned in the central region of the core ply 116. In some implementations, the window 120 of the core ply 116 has an arch shape (see, e.g., FIG. 1). In some implementations, the arch shape of the window 120 emulates the curve of an eyebrow. In some implementations, the window 120 of the core ply 116 may be any suitable shape. The window 120 of the core ply 116 is larger (or wider) than the area defined by the cosmetic formula 118*a*, 118*b* deposited on the right brow 114 and left brow 112 applicators (see, e.g., FIG. 2). In this way, the cosmetic formula 118*a*, 118*b* is prevented from making contact with the interior edge 122 of the window 120 and being disrupted thereby (see, e.g., FIG. 2).

As shown in FIG. 2, in some implementations, the width of the window 120 opening is sized to provide a minimum of 0.125" (inch) of clearance between all sides of the deposited cosmetic formula 118*a*, 118*b* and the interior edge 122 of the window 120. In some implementations, the interior edge 122 of the window 120 may provide more than, or less than, 0.125" (inch) of clearance between all sides of the deposited cosmetic formula 118*a*, 118*b* and the interior edge 122 of the window 120.

As shown in FIG. 2, in some implementations, the window 120 enables a clear or substantially clear line of sight through the core ply 116 even when the right brow 114 and/or the left brow 112 applicators are secured to the first side 117*a*, and the second side 117*b*, respectively, of the core ply 116. In some implementations, the right brow 114 and the left brow 112 applicators may be positioned on the assembled eyebrow applicator 100 in a mirrored fashion, separated by the core ply 116 (see, e.g., FIG. 2). In some implementations, the right brow 114 and the left brow 112 applicators may be positioned on the assembled eyebrow applicator 100 so that the side of each brow applicator 114, 112 having the cosmetic formula 118*a*, 118*b* thereon is secured to the core ply 116 and the cosmetic formula 118*a*, 118*b* is thereby positioned within the window 120 (see, e.g., FIG. 2). In this way, the brow applicators 114, 112 are kept separated thereby preventing smudging and/or smearing of the cosmetic formula 118*a*, 118*b* thereon (see, e.g., FIG. 2).

As shown in FIG. 2, in some implementations, the assembled eyebrow applicator 100 comprises a right brow applicator 114 and a left brow applicator 112 separated by a core ply 116, as described above. The right brow applicator 114 and the left brow applicator 112 are removably secured to the first side 117*a* and the second side 117*b*, respectively, of the core ply 116 through the use of an adhesive 130. The cosmetic formula 118*a*, 118*b* is deposited on the side of each brow applicator 114, 112 that is removably secured to the core ply 116. As a result of the window 120 through the core ply 116, the cosmetic formula 118*a*, 118*b* is substantially devoid of contact with any surface other than the brow applicator 114, 112 to which is secured. Further, the thickness of the core ply 116, and thereby the depth of the window 120, prevents the cosmetic formula 118*a*, 118*b* deposited on each brow applicator 114, 112 from contacting the other.

In some implementations, the assembled eyebrow applicator 100 is pliable, which may be the result of the material used to make the core ply 116 and/or the brow applicators 114, 112. In this way, the eyebrow applicator 100 may accommodate (or conform to) the natural curvature of a user's brow ridge when it is pressed there against to simulate how the cosmetic eyebrow would look once applied.

In some implementations, the clear polymer film of each brow applicator 114, 112 aids in placing the cosmetic eyebrows 118*a*, 118*b* onto a desired location, creating symmetrical eyebrows, and/or eliminating guesswork about brow shaping.

Figure 3:
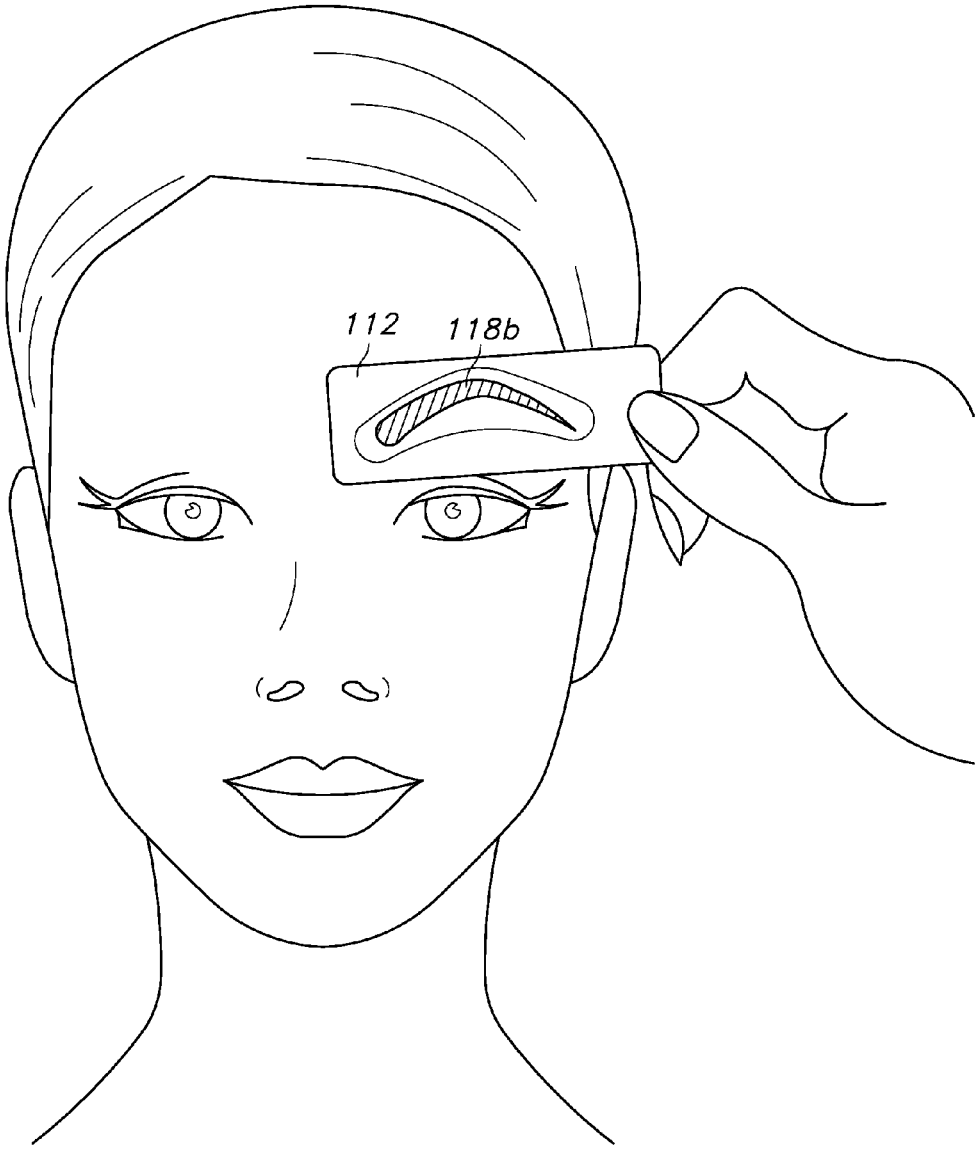
FIG. 3 illustrates the selection of a placement location of a cosmetic eyebrow using an implementation of the eyebrow applicator of the present disclosure.
Figure 4:
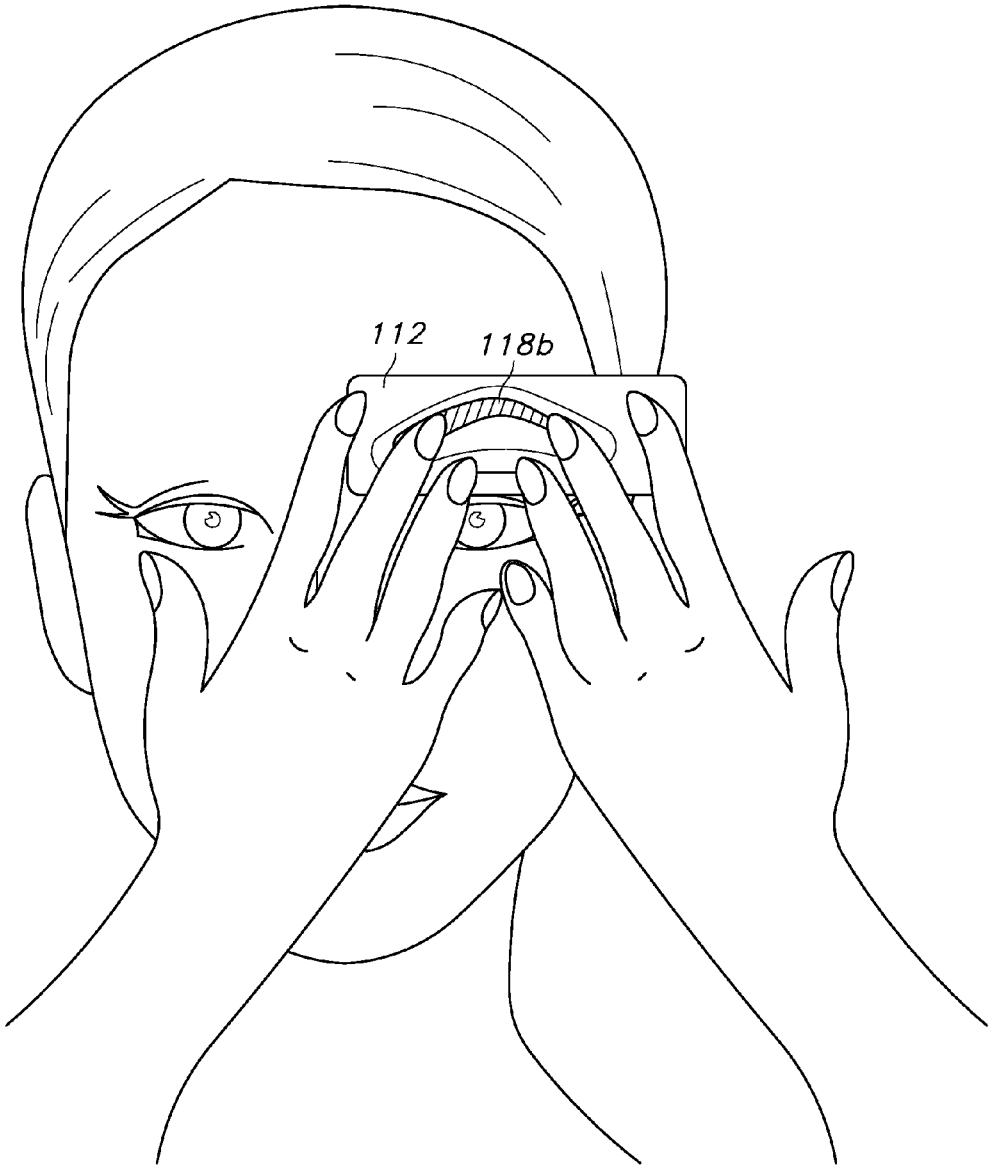
FIG. 4 illustrates the application of a cosmetic eyebrow using an eyebrow applicator constructed in accordance with the present disclosure.

As shown in FIGS. 3 and 4, in some implementations, a method of applying cosmetic eyebrows using the eyebrow applicator 100 is provided.

In some implementations, an eyebrow applicator 100 having the desired cosmetic eyebrows thereon is initially selected by the user.

Then, the left brow applicator 112 is peeled off of the core ply 116 of the eyebrow applicator 100 (see, e.g., FIG. 2 which shows the right brow applicator 114 begin peeled off of the core ply 116).

Next, as shown in FIG. 3, aligning the left brow applicator 112 over a desired placement site on the user's brow ridge using the clear polymer film. In this way, the clear polymer film allows the applicator 112 to facilitate visually referencing the placement of the cosmetic eyebrow prior to application on the user's skin.

Then, as shown in FIG. 4, pressing the left brow applicator 112 against the user's brow ridge thereby depositing at least a portion of the cosmetic formula 118*b* thereon. In this way, a cosmetic eyebrow is placed on the skin of the user's brow ridge.

Next, in some implementations, blotting the cosmetic formula 118*b* deposited on the user's skin with an absorbent material (e.g., tissue). In this way, excess liquids such as oils may be absorbed out of the cosmetic formula 118*b* thereby causing the remaining cosmetic formula to more effectively adhere to the skin and/or hair of a user.

Then, the above steps may be repeated in order to apply the cosmetic eyebrow 118*a* on the right brow applicator 114 to the user's right brow ridge.

In some implementations, the method of applying cosmetic eyebrows using an eyebrow applicator 100 may further comprise the steps of, initially selecting an eyebrow applicator 100 having a desired cosmetic eyebrow thereon from a selection of cosmetic eyebrows of varying size, shape, and/or color.

Then, placing the eyebrow applicator 100 over a portion of the user's eyebrow ridge and viewing the brow ridge and cosmetic eyebrow through the window 120 of the eyebrow applicator 100. In this way, the cosmetic eyebrow may be selected in context of the user's brow ridge thereby allowing the look and appeal of the selected cosmetic eyebrow to be ascertained prior to its application to the skin. If the cosmetic eyebrow is found not desirable to the user, another eyebrow applicator 100 (and thereby cosmetic eyebrows) is selected and the process repeated.

In some implementations, slight contact on the side of the brow applicator 114, 112 free of cosmetic formula 118*a*, 118*b* is all that is needed to deposit a portion of the cosmetic formula 118*a*, 118*b* on the skin and/or hair of a user.

In some implementations, the eyebrow applicator 100 may be multi-use such that the application of the cosmetic eyebrows 118*a*, 118*b* provided thereby can be repeated using the same brow applicators 114, 112. In some implementations, there may be a sufficient amount of cosmetic formula 118*a*, 118*b* applied to the brow applicators 114, 112, respectively, to allow each brow applicator to be used three to five times. In some implementations, there may be an amount of cosmetic formula 118*a*, 118*b* applied to each brow applicator 114, 112, respectively, to allow each brow applicator to be used less than three times or more than five times.

Initially, in some implementations, an array of windows 120 may be cut from a single piece of material using a die-cutting process. Next, in some implementations, an array of core ply 116 may be cut from a single sheet of material using a die-cutting process. In some implementations, to minimize the risk of the brow applicators 114,112 touching one another during the die-cutting process which is used to cut out each core ply 116, the ejector pads used to position the die of a die-cutting machine used to form the window 120 of the core ply 116 are removed. In this way, pressures from the die cutting procedure which could force the brow applicators 114, 112 to contact one another are removed.

In addition to the above described implementations of the eyebrow applicator 100 and its method of use, other implementations of the eyebrow applicator are envisioned. In one additional implementation, the cosmetic formula is deposited on each brow applicator in various patterns so that when the cosmetic formula is applied to a user's brow ridge a template or pattern is left behind. In this way, a user may see which hairs are outside of the provided template or pattern and then remove them (e.g., pluck or trim the hairs) to leave behind an eyebrow having the shape of the pattern or template. In this implementation, the cosmetic formula may be brightly colored so that hairs not so colored may be easily spotted and plucked or trimmed. In this way, the cosmetic formula provides guidance to the user so they can conform their brows to a desired shape. After the hair is removed, the cosmetic formula is removed leaving behind an eyebrow having the desired shape.

In another implementation of the present invention, the cosmetic formula is deposited on each brow applicator in a pattern that only defines the outline of a desired brow shape or only a portion thereof. Or, in other words, the shape of the cosmetic formula on each applicator defines an area (or void) where eyebrow hair is not desired. In some implementations, the cosmetic formula may be a wax material. When using an eyebrow applicator having a wax pattern thereon, the eyebrow applicator may be heated (e.g., by a microwave) to soften and activate the wax. Then, the softened, patterned wax may be applied to the user's brow ridge. In this way, the wax may adhere to the hairs desired to be removed and not to the hairs the user's desires to retain. Once the deposited, patterned wax has cooled, the deposited, patterned wax is removed. In this way, the unwanted hair is removed leaving behind a shapely eyebrow.

In keeping with the spirit of the present invention, the eyebrow applicator may be adapted to apply other decorative cosmetic art and/or body art. For example, the cosmetic formula may be used to create multi-color art. Also, glitter, and/or shimmer could be added to the cosmetic formula. Like the above-described cosmetic formula, these implementations of the cosmetic formula may become more fixed to the skin through blotting.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. An eyebrow applicator comprising:

a core ply having a first side, a second side, and a centrally positioned aperture extending therethrough;

a right brow applicator made of a clear polymer film, the right brow applicator is removably secured to the first side of the core ply, the right brow applicator includes a cosmetic formula on one side thereof having the shape of an eyebrow;

a left brow applicator made of a clear polymer film, the left brow applicator is removably secured to the second side of the core ply, the left brow applicator includes a cosmetic formula on one side thereof having the shape of an eyebrow; and a pressure sensitive adhesive, the pressure sensitive adhesive is used to removably secure the right brow applicator and the left brow applicator to the core ply;

wherein the side of the right brow applicator and the left brow applicator with the cosmetic formula thereon is positioned against the first side and the second side of the core ply, respectively, thereby placing the cosmetic formula on each brow applicator within the centrally positioned aperture of the core ply.

2. The eyebrow applicator of claim 1 wherein the right brow applicator and the left brow applicator are each removably secured to the core ply in a mirrored fashion.

3. The eyebrow applicator of claim 1 wherein the pressure sensitive adhesive is only deposited on the portion of the first side and the second side of the core ply adjacent an interior edge of the centrally positioned aperture.

4. The eyebrow applicator of claim 1 wherein the centrally positioned aperture is arch shaped thereby emulating the curve of an eyebrow.

5. The eyebrow applicator of claim 1 wherein the centrally positioned aperture is wider than the area occupied by the cosmetic formula located on either the right brow applicator or the left brow applicator, thereby preventing the cosmetic formula of either brow applicator from making contact with an interior edge of the centrally positioned aperture.

6. The eyebrow applicator of claim 1 wherein the core ply, the right brow applicator, and the left brow applicator are pliable, thereby allowing the eyebrow applicator to conform to the natural curvature of a user's brow ridge when pressed thereagainst.

7. The eyebrow applicator of claim 1 wherein the core ply, the right brow applicator, and the left brow applicator have a generally rectangular shape.

8. The eyebrow applicator of claim 1 wherein the right brow applicator and the left brow applicator each have the cosmetic formula positioned on the longitudinal axis thereof.

9. A method of using the eyebrow applicator of claim 1, the method comprising:

peeling the left brow applicator off of the core ply;

aligning the left brow applicator over a brow ridge of a user;

pressing the left brow applicator against the skin on the user's brow ridge thereby depositing a portion of the cosmetic formula thereon; and peeling the right brow applicator off of the core ply;

aligning the right brow applicator over a brow ridge of the user;

pressing the right brow applicator against the skin on the user's brow ridge thereby depositing a portion of the cosmetic formula thereon.

10. The method of claim 9 further comprises using an absorbent material to blot the cosmetic formula deposited on the skin of the user's brow ridge.

11. The method of claim 9 further comprises:

placing the eyebrow applicator over a portion of the user's brow ridge; and viewing simultaneously the brow ridge of the user and the cosmetic formula shaped like an eyebrow through the centrally positioned aperture of the eyebrow applicator prior to removing the left brow applicator or the right brow applicator from the core ply.

12. The method of claim 11 wherein the core ply, the right brow applicator, and the left brow applicator are pliable, the method further comprising:

pressing the eyebrow applicator against a portion of the user's brow ridge thereby allowing the eyebrow applicator to conform to the natural curvature of the user's brow ridge.

13. The method of claim 11 further comprises using an absorbent material to blot the cosmetic formula deposited on the skin of the user's brow ridge.

14. A method of applying cosmetic eyebrows using an eyebrow applicator, the method comprising:

providing the eyebrow applicator, the eyebrow applicator comprising a core ply having a first side, a second side, and a centrally positioned aperture extending therethrough; a right brow applicator made of a clear polymer film, the right brow applicator is removably secured to the first side of the core ply, the right brow applicator includes a cosmetic formula on one side thereof having the shape of an eyebrow; and a left brow applicator made of a clear polymer film, the left brow applicator is removably secured to the second side of the core ply, the left brow applicator includes a cosmetic formula on one side thereof having the shape of an eyebrow; wherein the side of the right brow applicator and the left brow applicator with the cosmetic formula thereon is positioned against the first side and the second side of the core ply, respectively, thereby placing the cosmetic formula on each brow applicator within the centrally positioned aperture of the core ply;

removing the left brow applicator from the core ply;

aligning the left brow applicator over a brow ridge of a user;

pressing the left brow applicator against the skin on the user's brow ridge thereby depositing a portion of the cosmetic formula thereon;

removing the right brow applicator from the core ply;

aligning the right brow applicator over a brow ridge of the user;

pressing the right brow applicator against the skin on the user's brow ridge thereby depositing a portion of the cosmetic formula thereon; and using an absorbant material to blot the cosmetic formula deposited on the skin of the user's brow ridge.

15. The method of claim 14 further comprises:

positioning the eyebrow applicator over a portion of the user's brow ridge; and viewing simultaneously the brow ridge of the user and the cosmetic formula shaped like an eyebrow through the centrally positioned aperture of the eyebrow applicator prior to removing the left brow applicator or the right brow applicator from the core ply.

16. The method of claim 15 wherein the core ply, the right brow applicator, and the left brow applicator are pliable, the method further comprising:

pressing the eyebrow applicator against a portion of the user's brow ridge thereby allowing the eyebrow applicator to conform to the natural curvature of the user's brow ridge.

17. The method of claim 14 wherein the core ply, the right brow applicator, and the left brow applicator are pliable, the method further comprising:

pressing the eyebrow applicator against a portion of the user's brow ridge thereby allowing the eyebrow applicator to conform to the natural curvature of the user's brow ridge.

* * * * *